US005109549A

United States Patent [19]

Mattinson

[11] Patent Number: 5,109,549

[45] Date of Patent: May 5, 1992

[54] ANTI-FLASH HOOD

[76] Inventor: Beverley I. Mattinson, 6 Flash Lane, Bollington, Nr. Macclesfield SK10 5AQ, England

[21] Appl. No.: 526,660

[22] Filed: May 22, 1990

[30] Foreign Application Priority Data

May 24, 1989 [GB] United Kingdom ..... 8911929

[51] Int. Cl.[5] ..... A42B 1/04

[52] U.S. Cl. ..... 2/202; 2/7; 2/205; 2/423

[58] Field of Search ..... 2/5, 7, 8, 171, 202, 2/203, 204, 205, 410, 423

[56] References Cited

U.S. PATENT DOCUMENTS

| | | | |
|---|---|---|---|
| 645,286 | 3/1900 | Bader | 2/5 |
| 1,398,165 | 11/1921 | Whiteside | 2/202 |
| 1,510,145 | 9/1924 | Huson | 2/202 |
| 1,687,346 | 10/1928 | Mondl | 2/205 |
| 1,691,202 | 11/1928 | La Van | 2/205 |
| 2,293,308 | 8/1942 | Riddell | 2/410 |
| 2,601,680 | 7/1952 | Shaw | 2/202 |
| 2,759,187 | 8/1956 | Woodard | 2/8 |
| 2,902,692 | 9/1959 | Christy | 2/423 |
| 3,239,842 | 3/1966 | Marchello | 2/423 |
| 3,423,763 | 1/1969 | Schwartz | 2/171 |
| 3,562,813 | 2/1971 | Origer | 2/202 |
| 4,231,118 | 11/1980 | Nakagawa | 2/7 |
| 4,411,023 | 10/1983 | Pinson | 2/7 |
| 4,748,705 | 6/1988 | Johnson | 8/115.57 |
| 4,870,959 | 10/1989 | Reisman | 2/7 |
| 4,972,520 | 11/1990 | Grilliot | 2/7 |

FOREIGN PATENT DOCUMENTS

| | | | |
|---|---|---|---|
| 56613 | 7/1982 | European Pat. Off. | 2/202 |
| 953456 | 12/1949 | France | 2/202 |
| 1214768 | 4/1960 | France | 2/423 |
| 8606971 | 12/1986 | Italy | 2/205 |
| 175594 | 6/1961 | Sweden | 2/202 |
| 523530 | 7/1940 | United Kingdom | 2/204 |
| 2105177 | 3/1983 | United Kingdom | 2/202 |
| 2129670 | 5/1984 | United Kingdom | 2/7 |

*Primary Examiner*—Werner H. Schroeder
*Assistant Examiner*—Diana L. Biefeld
*Attorney, Agent, or Firm*—Charles J. Brown

[57] ABSTRACT

There is disclosed an anti-flash hood of the kind referred to comprising a cover of heat resistant material having at least one area therein adapted to overlie an area of skin of the wearer and of relatively light weight to enable a wearer to have more rapid awareness of temperature changes in the environment than without such area.

7 Claims, 1 Drawing Sheet

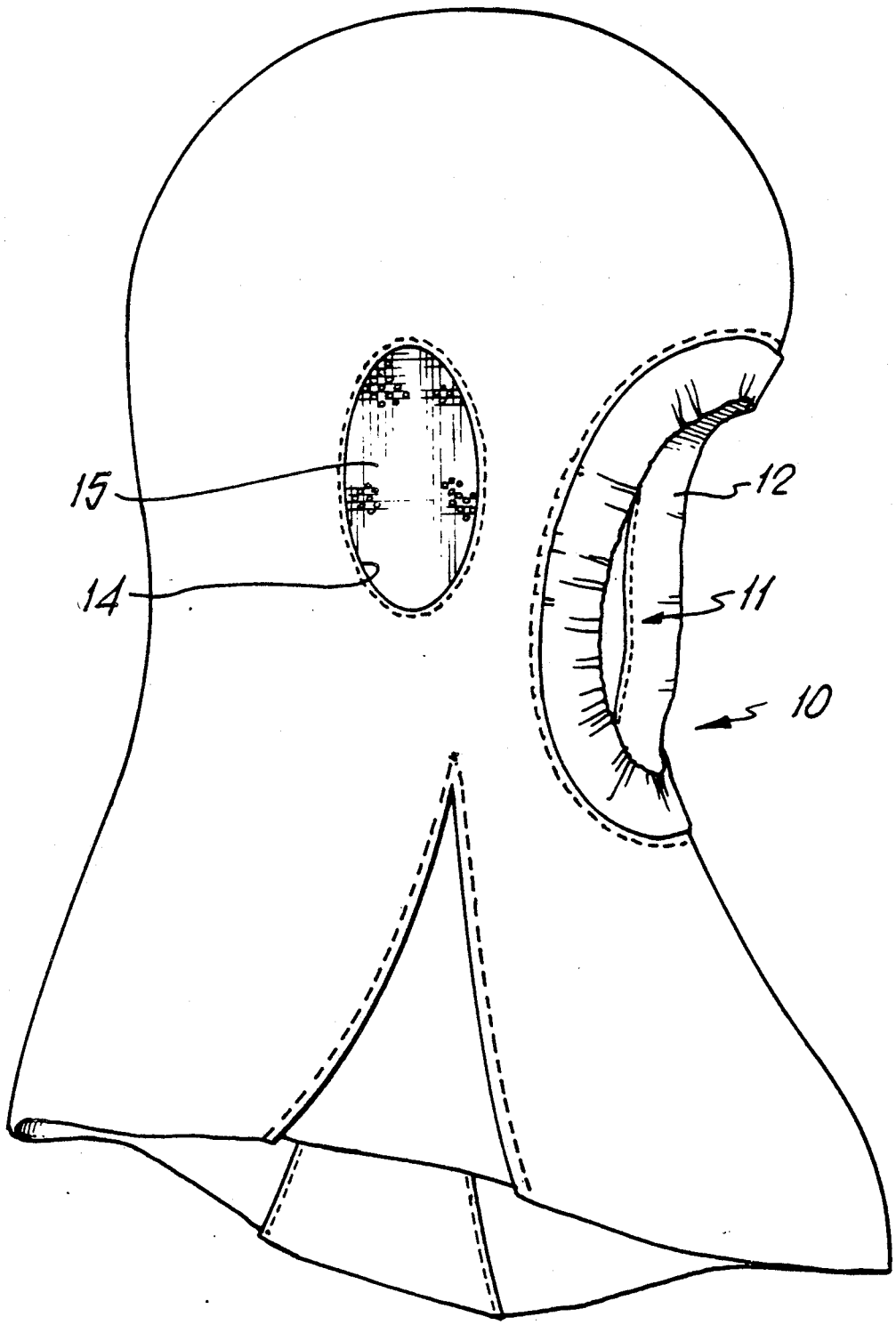
15
14
12
11
10

ANTI-FLASH HOOD

This invention concerns an anti-flash hood of the kind (hereinafter termed of the kind referred to) adapted to be worn by those working in an environment and at risk from the flash of an explosion or similar, particularly, though by no means exclusively, firemen, to protect the head and more especially the face from burns which would otherwise result.

Anti-flash hoods of the kind referred to are usually of a textile fabric which is of a heat resistant nature. The heat resistant properties may be inherent as with an aramid fibre, for example Nomex (RTM) or applied by treatment with a flame retardant, for example Proban (RTM).

Generally the wearer of such a hood is completely isolated from thermal sensory perception, all other skin areas being totally enclosed or covered.

It is well known that in certain situations at least the environmental temperature is indicative of the degree of hazard present. For example, sudden temperature rise can be the precursor to an explosive situation. Conventional anti-flash hoods and the garments which would ordinarily accompany them deprive the wearer of such possibly vital information.

It is an object of the present invention to provide an anti-flash hood which overcomes at least to some extent the problem aforesaid.

According to the present invention there is provided an anti-flash hood of the kind referred to comprising a cover of heat resistant material having at least one area therein adapted to overlie an area of skin of the wearer and of relatively light weight to enable a wearer to have more rapid awareness of temperature changes in the environment than without such area.

The area may be an aperture closed by a perforated heat resistant material.

The number and sizes of the perforations are selected such that whilst indications of environmental temperature can be sensed by the underlying skin, such would be largely protected in the event of a flash condition.

There may be two apertures adapted to overlie the ears of the wearer. The ears are known to be particularly sensitive.

The hood may include an opening at the front adapted to fit over breathing apparatus. Such opening may have an elasticated border.

The body of the hood may be of a Proban (RTM) treated loop wheel cotton fabric.

The infill to the apertures may also be of a Proban treated cotton 'eyelet' fabric.

The invention will be further apparent from the following description with reference to the single figure of the accompanying drawing, which shows, by way of example only, one form of hood embodying same.

Referring now to the drawing, it will be seen that the anti-flash hood comprises a generally helmet shaped fabrication 10 of textile material. The material is a cotton loop wheel fabric which has been treated to render it flame retardent to BS 6249 Part 1 by Proban (RTM).

There is a large opening 11 at the front of the hood adapted to fit around breathing apparatus used by the wearer. The opening 11 has an elasticated border 12.

At the sides of the hood are apertures 14 adapted to overlie the ears of the wearer. These apertures are infilled with a perforated fabric 15 sewn to the main body of the hood. The fabric 15 is an 'eyelet' cotton fabric, again rendered flame retardent by treatment with Proban. The number and sizes of the perforations are such as to permit the ears to sense environmental temperature whilst the fabric maintains a high degree of protection against burns in the event of flash conditions. Typically there might be nine or ten perforations per square centimetre, each having a mean diameter of 2 mm of thereabouts.

It will be appreciated that it is not intended to limit the invention to the above example only, many variations, such as might readily occur to one skilled in the art, being possible, without departing from the scope thereof as defined by the apended claims.

Thus, for example, instead of providing a hood with apertures infilled with relatively lightweight material, the hood may be fabricated from material having areas therein of relatively light weight arising from appropriate knitting or weaving patterns.

Again, for example, the hood may comprise two layers, one light weight and another of heavier weight having an aperture therein superimposed with the light weight layer.

I claim:

1. An anti-flash hood of the kind referred to comprising a cover of heat resistant material having at least one area therein adapted to overlie a predetermined area of skin of the wearer and being heat resistant and being of relatively lighter weight than a remainder of the cover of heat resistant material to enable a wearer to have more rapid awareness of temperature changes in the environment than without such area.

2. An anti-flash hood according to claim 1, wherein said area is an aperture closed by a perforated heat resistant material.

3. An anti-flash hood according to claim 2, wherein number and sizes of the perforations are selected such that whilst indications of environmental temperature can be sensed by the underlying skin, such would be largely protected in the event of a flash condition.

4. An anti-flash hood according to claim 3, wherein there are about ten perforations per square centimetre, each having a mean diameter of 2 mm thereabouts.

5. An anti-flash hood according to any preceding claim, wherein there are apertures adapted to overlie the ears of the wearer.

6. An anti-flash hood according to any preceding claim, wherein the hood includes an opening at the front adapted to fit over breathing apparatus.

7. An anti-flash hood according to claim 2, wherein the body of the hood is of a Proban (RTM) treated loop wheel cotton fabric and the closure of the aperture is of a Proban treated cotton 'eyelet' fabric.

* * * * *